US005595323A

United States Patent [19]

Day

[11] Patent Number: 5,595,323

[45] Date of Patent: Jan. 21, 1997

[54] SECURE PERIODICAL VENDING MACHINE

[76] Inventor: James W. Day, 19431 N. 67th Dr., Glendale, Ariz. 85308

[21] Appl. No.: 422,985

[22] Filed: Apr. 17, 1995

[51] Int. Cl.[6] ..... B65H 3/00

[52] U.S. Cl. ..... 221/194; 221/86

[58] Field of Search ..... 221/194, 195, 221/196, 86, 90, 84, 85, 89

[56] References Cited

U.S. PATENT DOCUMENTS 4,506,800 3/1985 Wingate ..... 221/194

5,368,189 11/1994 Griffith ..... 221/195

*Primary Examiner*—Kenneth Noland

[57] ABSTRACT

A machine for dispensing individual copies of a periodical. The inventive device includes a housing having a dispensing aperture extending through a front wall thereof. A hopper is mounted within the housing and includes a plurality of separate receiving bins for receiving an individual periodical. A coin changer receives coins to open an individual receiving bin to dispense a periodical through the slot in the housing to a customer.

7 Claims, 4 Drawing Sheets

SECURE PERIODICAL VENDING MACHINE

BACKGROUND OF THE INVENTION

1. Field of the Invention

The present invention relates to vending devices and more particularly pertains to an secure periodical vending machine for dispensing individual copies of a periodical to a customer.

2. Description of the Prior Art

The use of vending devices is known in the prior art. More specifically, vending devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art vending devices include U.S. Pat. No. 4,655,369; U.S. Pat. No. 4,865,178; U.S. Pat. No. 4,858,743; U.S. Pat. No. 4,734,005; U.S. Pat. No. 4,583,658; and U.S. Pat. No. 4,140,242.

While these devices fulfill their respective, particular objectives and requirements, the aforementioned patents do not disclose a secure periodical vending machine for dispensing individual copies of a periodical which includes housing having an dispensing aperture extending through a front wall thereof, a hopper mounted within the housing and including a plurality of separate receiving bins for receiving individual periodicals, and a coin changer receiving coins from a customer to open an individual receiving bin to dispense a periodical through the slot in the housing to the customer.

In these respects, the secure periodical vending machine according to the present invention substantially departs from the conventional concepts and designs of the prior art, and in so doing provides an apparatus primarily developed for the purpose of dispensing individual copies of a periodical to a customer.

SUMMARY OF THE INVENTION

In view of the foregoing disadvantages inherent in the known types of vending devices now present in the prior art, the present invention provides a new secure periodical vending machine construction wherein the same can be utilized for dispensing individual copies of a newspaper or magazine. As such, the general purpose of the present invention, which will be described subsequently in greater detail, is to provide a new secure periodical vending machine apparatus and method which has many of the advantages of the vending devices mentioned heretofore and many novel features that result in a secure periodical vending machine which is not anticipated, rendered obvious, suggested, or even implied by any of the prior art vending devices, either alone or in any combination thereof.

To attain this, the present invention generally comprises a machine for dispensing individual copies of a periodical. The inventive device includes a housing having a dispensing aperture extending through a front wall thereof. A hopper is mounted within the housing and includes a plurality of separate receiving bins for receiving an individual periodical. A coin changer receives coins to open an individual receiving bin to dispense a periodical through the slot in the housing to a customer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new secure periodical vending machine apparatus and method which has many of the advantages of the vending devices mentioned heretofore and many novel features that result in a secure periodical vending machine which is not anticipated, rendered obvious, suggested, or even implied by any of the prior art vending devices, either alone or in any combination thereof.

It is another object of the present invention to provide a new secure periodical vending machine which may be easily and efficiently manufactured and marketed.

It is a further object of the present invention to provide a new secure periodical vending machine which is of a durable and reliable construction.

An even further object of the present invention is to provide a new secure periodical vending machine which is susceptible of a low cost of manufacture with regard to both materials and labor, and which accordingly is then susceptible of low prices of sale to the consuming public, thereby making such secure periodical vending machines economically available to the buying public.

Still yet another object of the present invention is to provide a new secure periodical vending machine which provides in the apparatuses and methods of the prior art some of the advantages thereof, while simultaneously overcoming some of the disadvantages normally associated therewith.

Still another object of the present invention is to provide a new secure periodical vending machine for dispensing individual copies of a periodical to a customer.

Yet another object of the present invention is to provide a new secure periodical vending machine which includes housing having an dispensing aperture extending through a front wall thereof, a hopper mounted within the housing and including a plurality of separate receiving bins for receiving individual periodicals, and a coin changer receiving coins from a customer to open an individual receiving bin to dispense a periodical through the slot in the housing to the customer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
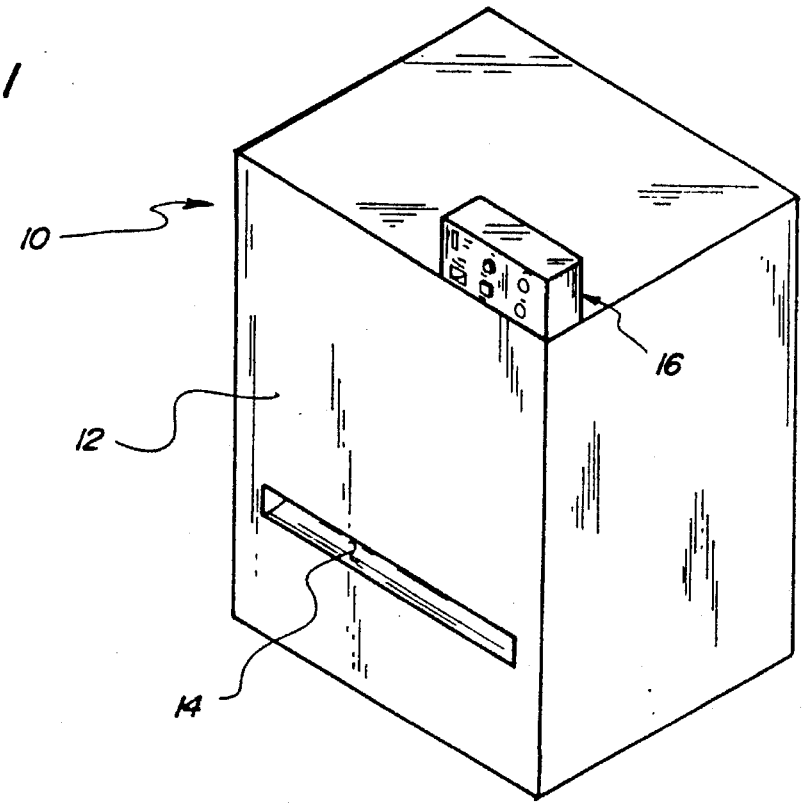
FIG. 1 is an isometric illustration of a secure periodical vending machine according to the present invention.

With reference now to the drawings, and in particular to FIGS. 1–8 thereof, a new secure periodical vending machine embodying the principles and concepts of the present invention and generally designated by the reference numeral 10 will be described.

Figure 3:
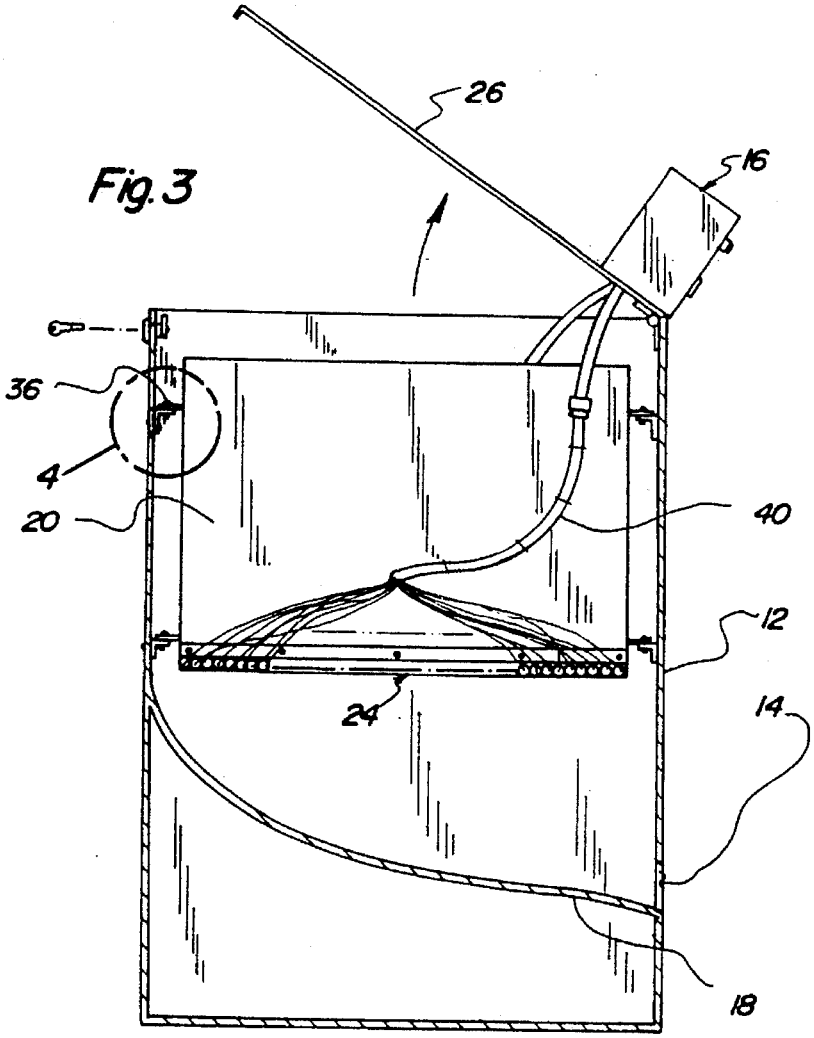
FIG. 3 is a cross sectional view of the invention illustrating interior components thereof.
Figure 5:
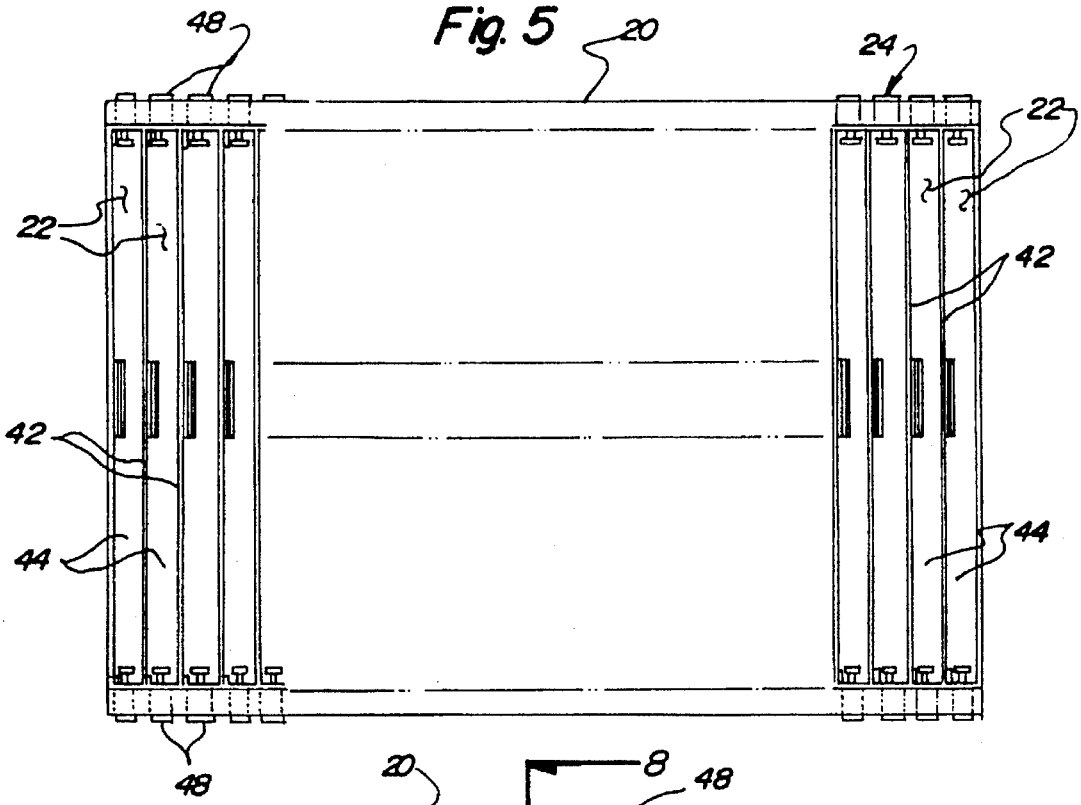
FIG. 5 is a top plan view of a hopper comprising a portion of the present invention.

More specifically, it will be noted that the secure periodical vending machine 10 comprises a housing 12 positionable in a convenient location where conventionally known newspaper vending machines are typically positioned. The housing 12 is shaped so as to define a dispensing aperture 14 directed through a front wall thereof through which a newspaper or other periodical can be dispensed in a manner which will subsequently described in more detail. A coin changer 16 is mounted to the housing 12 and receives coins or other money from a customer to effect operation of the device 10. As shown in FIG. 3, a guide chute 18 extends through the housing 12 and into contiguous communication with the dispensing aperture 14 thereof. A rectangular hopper 20 is secured within the housing 12 and positioned above the guide chute 18. The rectangular hopper 20 includes a plurality of vertical receiving bins 22, as shown in FIG. 5, within which a plurality of newspapers or other periodicals can be individual positioned. A latch means 24 extends along a lower surface of the rectangular hopper 20 between the hopper and the guide chute 78 and is positioned in electrical communication with the coin changer 16, as shown in FIG. 3 of the drawings, for selectively permitting communication between an individual one of the vertical receiving bins 22 and the guide chute 18 such that a periodical residing within the individual one to the receiving bins can be gravitationally biased from the rectangular hopper 20 and onto the guide chute 18 for dispensing through the aperture 14 in the front of the housing 32. By this structure, an individual can purchase a periodical by inserting coins or other money into the coin changer 16, whereby only a single periodical is then dispensed for removal by the customer.

Figure 2:
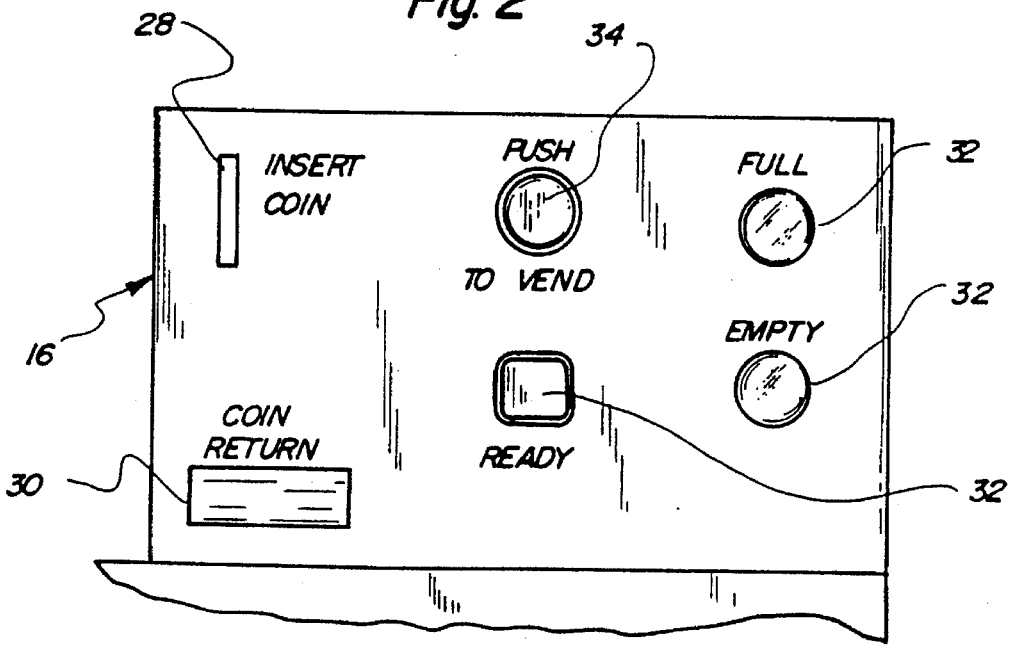
FIG. 2 is a front elevation view of a coin changer of the present invention.

As best illustrated in FIGS. 1 through 3, it can be shown that the coin changer 16 is mounted to a housing lid 26 which can be pivotally opened to facilitate access to an interior of the housing 12. The coin changer 16, as shown in FIG. 2, includes a coin slot 28 through which coins or other monetary instruments can be positioned. A coin return 30 can also be provided with the coin changer 36 to facilitate making of change for a customer if needed. A plurality of indicator lights 32 mounted to the front face of the coin changer 16 indicate a status of the machine 10. Once a desired amount of money has been positioned through the coin slot 28, an operating button 34 can be pushed so as to actuate the coin changer 16 to cause a dispensing of a single periodical from the device 10. The coin changer 16 can be battery operated or include an electrical cord permitting electrically coupling of the coin changer 16 to a standard power outlet. The components of the coin changer 16 enabling operation as described are conventionally known and will therefore not be described in detail.

Figure 4:
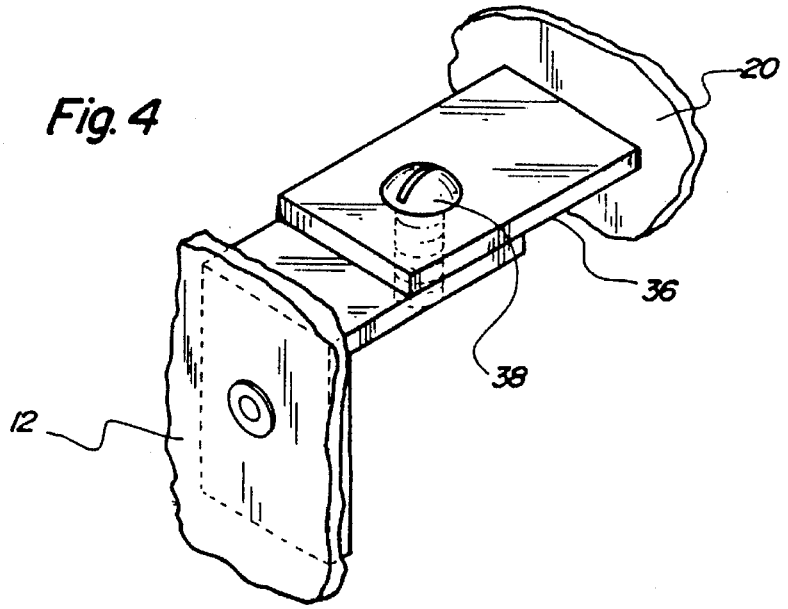
FIG. 4 is an isometric illustration of the area set forth in FIG. 3.

Referring now to FIGS. 3 and 4, it can be shown that the rectangular hopper 20 is removably coupled to an interior of the housing 12 by a plurality of releasable mounting brackets 36 extending therebetween. The releasable mounting brackets 36, as shown in FIG. 4, each include a fastener 38 which can be selectively removed to permit separation of the hopper 20 from the housing 12. By this structure, servicing and/or refilling of the present invention 10 can be easily accomplished by removing the rectangular hopper 20 as desired.

Figure 6:
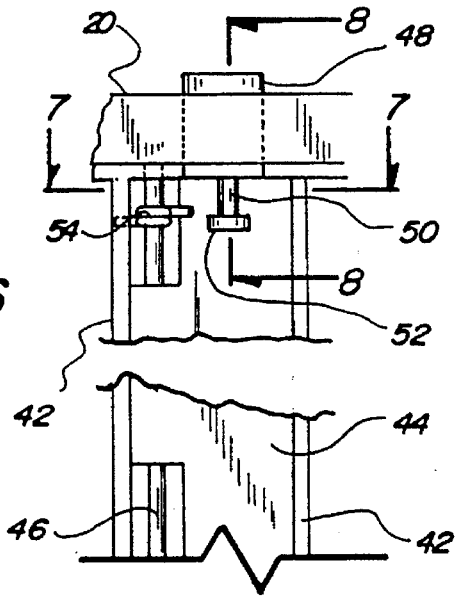
FIG. 6 is an enlarged bottom plan view of a portion of the hopper.
Figure 7:
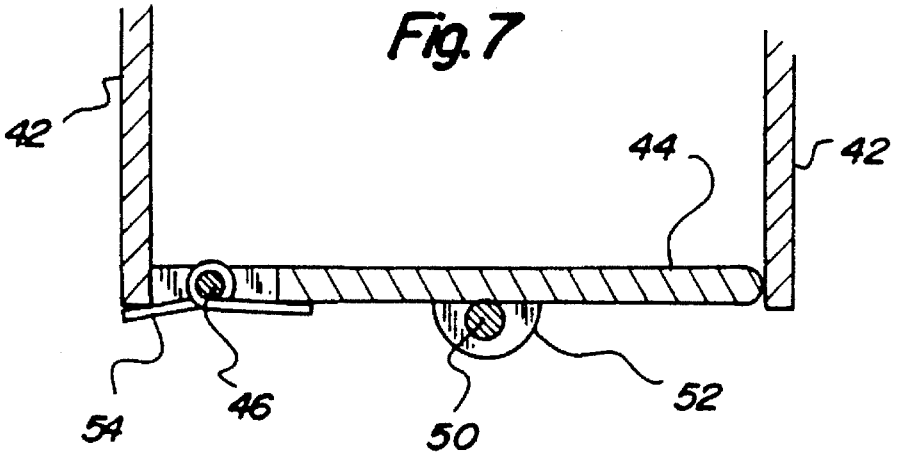
FIG. 7 is a cross sectional view taken along line 7—7 of FIG. 6.
Figure 8:
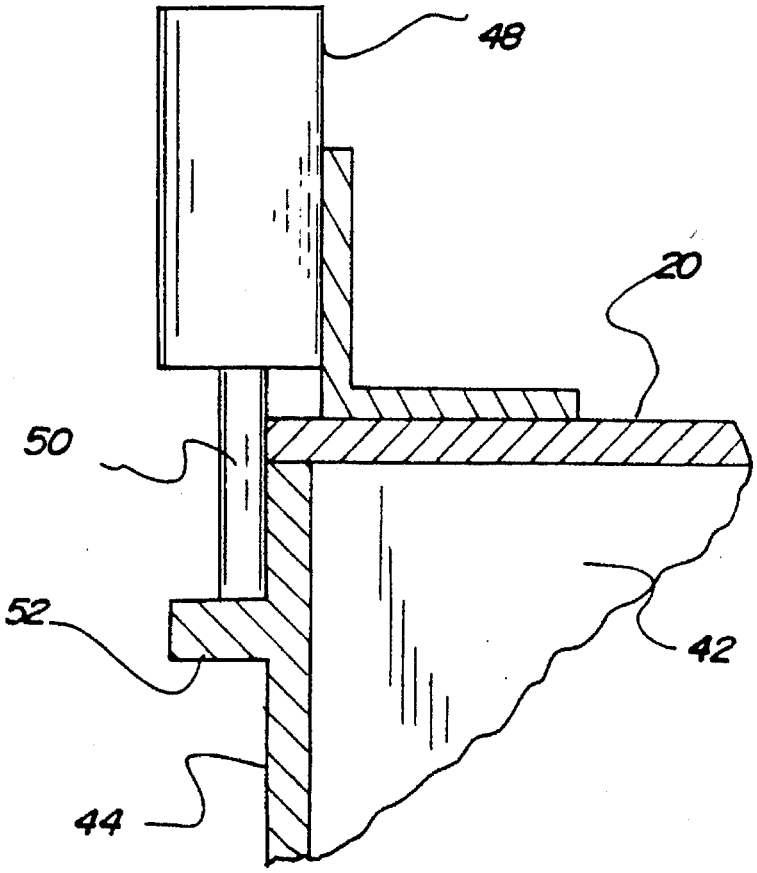
FIG. 8 is a cross sectional view taken along line 8—8 of FIG. 6.

As shown in FIG. 3, the coin changer electrically communicates with the latch means 24 through a wire harness 40 electrically coupled therebetween. Referring now to FIGS. 5 through 8 wherein the hopper 20 and the latch means 24 are illustrated in detail, it can be shown that the hopper 20 includes a plurality of dividing panels 42 extending transversely across an interior thereof. The dividing panels 42 are oriented so as to extend in a substantially spaced and parallel orientation relative to one another and cooperate to define the plurality of vertical receiving bins 22 within the rectangular hopper 20. To permit selective dispensing of an individual periodical from a single one of the vertical receiving bins 22, the latch means 24 of the present invention 10 comprises a plurality of elongated doors 44 which are each mounted across a lower opening of an individual one of the vertical receiving bins 22. To this end, a door axle 46 extends transversely across the rectangular hopper 20 of the respective vertical receiving bin 22 and projects through a portion of the elongated door 44 so as to pivotally couple the same thereto. The latch means 24 further comprises a plurality of solenoid latches 48, with at least one solenoid latch being mounted to the rectangular hopper 20 proximal to each of the vertical receiving bins 22. The solenoid latches 48 each include a plunger 50 projecting below the respective elongated door 44 so as to preclude a downward pivoting thereof. If desired, an abutment plate 52 can be mounted to the lower surface of the elongated door 44 so as to limit an outward traveling of the plunger 50. The solenoid latches 48 are each individually coupled to the coin changer 16 by the wire harness 40 extending therebetween. The coin changer 16 thus operates to open a single one of the solenoid latches 48, or alternatively, a pair of solenoid latches securing a single one of the elongated doors 44 of a respective vertical receiving bin 22 in response to reception of an appropriate amount of money within the coin slot 28 and operation of the operating button 34 so as to dispense a single periodical from the respective vertical receiving bin 22. Thus, the coin changer 16 must sequentially operate the solenoid latches 48 so as to dispense a periodical from a vertical receiving bin 22 which has not already been purchased. In other words, the coin changer 16 will operate to release a first one of the elongated doors 44 during a first operation, with a second operation of the coin changer 16 effecting operation of a second one of the elongated doors 44, and so on. As shown in FIGS. 6 and 7, a plurality of springs 54 can be interposed between the elongated doors 44 and a respective dividing panel 42 so as to bias the elongated door 44 into a normally closed position. It should be noted that the spring 54 is weak enough to permit opening of the elongated door 44 under a gravitational weight of a periodical positioned therein, yet strong enough to effect closing of the elongated door 44 subsequent to the dispensing of the periodical from the associated vertical receiving bin 22. By this structure, reclosing of the elongated doors 44 subsequent to dispensing of periodicals from the device 10 is ensured such that the plunger 50 can be repositioned beneath the elongated door 44.

In use, the secure periodical vending machine 10 according to the present invention can be easily utilized for dispensing individual copies of a periodical to a consumer. The inventive device 10 substantially eliminates a possibility of a customer receiving more than a single copy of a periodical during purchasing thereof from the machine.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A secure periodical vending machine comprising:

a housing, the housing being shaped so as to define a dispensing aperture directed through a front wall thereof;

a coin changer mounted to the housing;

a guide chute extending through the housing and into contiguous communication with the dispensing aperture thereof;

dispensing means for selectively dispensing a single periodical onto the guide chute and through the dispensing aperture in response to an operation of the coin changer including a rectangular hopper secured within the housing and positioned above the guide chute, the rectangular hopper including a plurality of separate vertical receiving bins, within which a plurality of periodicals can be individual positioned; and a latch means extending along a lower surface of the rectangular hopper and positioned between the hopper and the guide chute, the latch means being positioned in electrical communication with the coin changer for selectively permitting communication between an individual one of the vertical receiving bins and the guide chute such that a periodical residing within the individual one of the receiving bins can be gravitationally biased from the rectangular hopper and onto the guide chute for dispensing through the aperture in the front of the housing.

2. The secure periodical vending machine of claim 1, wherein the rectangular hopper is removably coupled to an interior of the housing.

3. The secure periodical vending machine of claim 2, wherein the hopper includes a plurality of dividing panels extending transversely across an interior thereof, the dividing panels being oriented so as to extend in a substantially spaced and parallel orientation relative to one another and cooperate to define the plurality of vertical receiving bins.

4. The secure periodical vending machine of claim 3, wherein the latch means comprises a plurality of elongated doors which are each pivotally mounted across a lower opening of an individual one of the vertical receiving bins; a plurality of solenoid latches, with each of the solenoid latches being mounted to the rectangular hopper proximal to an individual one of the vertical receiving bins, the solenoid latches each including a plunger projecting below the respective elongated door so as to preclude a downward pivoting thereof, the solenoid latches each being in electrical communication with the coin changer.

5. The secure periodical vending machine of claim 4, wherein the coin changer sequentially operates the solenoid latches so as to dispense a periodical from a vertical receiving bin which has not already been purchased.

6. The secure periodical vending machine of claim 5, wherein the latch means further comprises a plurality of springs, with each of the springs being interposed between an individual on of the elongated doors and a respective one of the dividing panels so as to bias the elongated door into a normally closed position.

7. The secure periodical vending machine of claim 6 wherein the spring is permits opening of the elongated door under a gravitational weight of a periodical positioned therein, and effects closing of the elongated door subsequent to a dispensing of the periodical from the vertical receiving bin.

* * * * *